US010227980B2

(12) United States Patent
Nagano et al.

(10) Patent No.: US 10,227,980 B2
(45) Date of Patent: Mar. 12, 2019

(54) MOTOR-DRIVEN COMPRESSOR INCLUDING INJECTION PORT THAT DELIVERS INTERMEDIATE PRESSURE REFRIGERANT TO COMPRESSION CHAMBER

(71) Applicant: KABUSHIKI KAISHA TOYOTA JIDOSHOKKI, Kariya-shi, Aichi-ken (JP)

(72) Inventors: Hiroki Nagano, Kariya (JP); Yoshikazu Fukutani, Kariya (JP); Ken Suitou, Kariya (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 769 days.

(21) Appl. No.: 14/589,291

(22) Filed: Jan. 5, 2015

(65) Prior Publication Data

US 2015/0192127 A1 Jul. 9, 2015

(30) Foreign Application Priority Data

Jan. 8, 2014 (JP) ..... 2014-001676

(51) Int. Cl.

| | |
|---|---|
| ***F04C 28/24*** | (2006.01) |
| ***F04C 18/02*** | (2006.01) |
| ***F04C 29/12*** | (2006.01) |
| ***F04C 23/00*** | (2006.01) |
| *F04C 29/02* | (2006.01) |

(52) U.S. Cl.

CPC ..... *F04C 18/0261* (2013.01); *F04C 18/0215* (2013.01); *F04C 23/008* (2013.01); (Continued)

(58) Field of Classification Search

CPC ..... F04C 18/0261; F04C 23/008; F04C 18/0215; F04C 29/128; F04C 28/24; (Continued)

(56) References Cited

U.S. PATENT DOCUMENTS 3,568,712 A * 3/1971 Rinehart ..... F04B 39/1073 137/855
4,216,661 A * 8/1980 Tojo ..... F04C 18/0215 418/15

(Continued)

FOREIGN PATENT DOCUMENTS

DE 112013001840 T5 12/2014
EP 0768464 A2 4/1997

(Continued)

OTHER PUBLICATIONS

Communication dated May 15, 2018, issued by the German Patent Office in counterpart German Application No. 10 2015 100 017.2.

*Primary Examiner* — Dominick L Plakkoottam
*Assistant Examiner* — Stephen A Mick
(74) *Attorney, Agent, or Firm* — Sughrue Mion, PLLC

(57) ABSTRACT

A motor-driven compressor includes suction, discharge, and intermediate pressure housings. The accommodation housing includes a compression mechanism, which compresses refrigerant, and injection ports, which deliver intermediate pressure refrigerant to the compression mechanism from an external refrigerant circuit. The compressed refrigerant is discharged into the discharge housing. The intermediate pressure housing includes an intake port, which draws in the intermediate pressure refrigerant, an accommodation recess, which is connected to the intake port, and supply passages, which connect the accommodating recess to the injection ports. The accommodation recess accommodates the valve mechanism. The valve mechanism includes a valve plate, which has a valve hole that connects the intake port and the supply passages, and a reed valve formation plate including a reed valve, located between the valve plate and the supply passages, to open and close the valve hole.

6 Claims, 4 Drawing Sheets

(52) U.S. Cl.
CPC ..... *F04C 28/24* (2013.01); *F04C 29/128* (2013.01); *F04C 29/026* (2013.01)

(58) Field of Classification Search
CPC ..... F04C 29/026; F04C 29/12; F04C 29/225; F04C 29/10; F04C 2250/101; F04C 2250/102; F04C 2240/30; F04C 29/0085; F04C 29/124; F04C 29/126; F04C 28/26
USPC ..... 417/213
See application file for complete search history.

(56) References Cited

U.S. PATENT DOCUMENTS 4,744,733 A * 5/1988 Terauchi ..... F04C 28/16 417/310
5,228,468 A * 7/1993 Kapadia ..... F04B 53/105 137/1
5,247,912 A * 9/1993 Boyesen et al. ..... F01L 3/205 123/65 V
6,053,715 A 4/2000 Hirano et al.
2008/0184733 A1 8/2008 Skinner
2011/0014080 A1* 1/2011 Robillard ..... F04C 2/18 418/205
2015/0125330 A1 5/2015 Komura et al.
2015/0192127 A1* 7/2015 Nagano ..... F04C 18/0261 417/410.5

FOREIGN PATENT DOCUMENTS

EP 2 280 172 A1 2/2011
JP 2-54976 U 4/1990
JP 8-144971 A 6/1996
JP 08-303361 A 11/1996
JP 11-107945 A 4/1999
JP 2009-287512 A 12/2009

* cited by examiner

MOTOR-DRIVEN COMPRESSOR INCLUDING INJECTION PORT THAT DELIVERS INTERMEDIATE PRESSURE REFRIGERANT TO COMPRESSION CHAMBER

CROSS-REFERENCE TO RELATED APPLICATIONS

This application is based upon and claims the benefit of priority from prior Japanese Patent Application No. 2014-001676, filed on Jan. 8, 2014, the entire contents of which are incorporated herein by reference.

BACKGROUND OF THE INVENTION

The present invention relates to a motor-driven compressor including an injection port that delivers intermediate pressure refrigerant to a compression chamber.

Generally, an injection pipe, which forms a portion of an external refrigerant circuit, is connected to an injection port. A gas-liquid separator is connected to the injection pipe. A check valve is arranged in the injection pipe. The check valve opens the injection pipe during a high-load operation, such as when a warming operation is performed in a refrigeration cycle, and closes the injection pipe during a low-load operation, such as when a cooling operation is performed. During a high-load operation in the refrigeration cycle, the gas-liquid separator separates refrigerant into liquid refrigerant and gas refrigerant, which has an intermediate pressure. The intermediate pressure gas refrigerant is delivered to a compression chamber through the injection pipe and the injection port. This increases the amount of gas refrigerant that flows into the compression chamber and improves the performance of the motor-driven compression during a high-load operation in the refrigeration cycle.

To further improve the performance of the motor-driven compressor during a high-load operation in the refrigeration cycle, the injection port may be enlarged to increase the amount of gas refrigerant that flows into the compression chamber. However, if the motor-driven compressor is, for example, of a scroll type, an enlarged injection port would connect adjacent compression chambers as the orbiting motion of the movable scroll moves the spiral wall of the movable scroll to a location overlapped with the injection port. In such a case, refrigerant would leak from the compression chamber having a high pressure to the compression chamber having a lower pressure. This would lower the performance of the motor-driven compressor.

Thus, there is usually more than one injection port so that adjacent compression chambers are not connected through the same injection port when the spiral wall of the movable scroll moves. In comparison to when there is only one injection port, the employment of a plurality of injection ports increases the amount of gas refrigerant that flows into the compression chambers and further improves the performance of the motor-driven compressor during a high-load operation in the refrigeration cycle.

Further, the end of the injection port connected to the injection pipe includes a valve mechanism so that the refrigerant flowing from the compression chamber to the injection port does not reversely flow into the injection pipe. Japanese Laid-Open Patent Publication No. 8-303361 describes a prior art example of a valve mechanism. The valve mechanism includes a spool valve and a coil spring, which biases the spool valve to a valve close position and disconnects the injection port and the injection pipe.

When the pressure of the intermediate pressure gas refrigerant from the injection pipe acts on the spool valve, the spool valve moves to a valve open position against the biasing force of the coil spring and connects the injection port and the injection pipe. This delivers gas refrigerant to the compression chamber through the injection pipe and the injection port. When the pressure of the intermediate pressure gas refrigerant from the injection pipe no longer acts on the spool valve, the biasing force of the coil spring returns the spool valve to the valve close position. This restricts a reversed flow of the refrigerant from the compression chamber to the injection pipe via the injection port.

The spool valve reciprocates between the valve open position and the valve close position in accordance with the relationship of the biasing force of the coil spring and the pressure of the intermediate pressure gas refrigerant from the injection pipe. Thus, the response of the spool valve is slow. This may hinder smooth delivery of the gas refrigerant to the compression chamber from the injection pipe and the injection port. In this case, refrigerant may reversely flow from the compression chamber to the injection pipe through the injection port. Thus, it is difficult to improve the performance of the motor-driven compressor during a high-load operation in the refrigeration cycle.

Japanese Laid-Open Patent Publication No. 11-107945 describes another prior art example of a valve mechanism. The valve mechanism includes a reed valve and a retainer formation plate, which includes a retainer that restricts the open degree of the lead valve. The reed valve opens when the intermediate pressure refrigerant gas from the injection pipe acts on the reed valve. When the reed valve opens, contact with the retainer restricts the open degree of the reed valve. As the reed valve opens, gas refrigerant is delivered to the compression chamber from the injection pipe and the injection port. The reed valve closes when the pressure of the intermediate pressure gas refrigerant no longer acts on the reed valve. This restricts a reversed flow of the refrigerant from the compression chamber to the injection pipe via the injection port.

In comparison with the spool valve, which is configured to reciprocate between the valve open position and the valve close position in accordance with the relationship of the biasing force of the coil spring and the pressure of the intermediate pressure gas refrigerant from the injection pipe, the reed valve has a quicker response. Further, the reed valve allows the performance of the motor-driven compressor to be satisfactory during a high-load operation in the refrigeration cycle.

SUMMARY OF THE INVENTION

The use of the reed valve improves the performance of the motor-driven compressor. However, when a valve mechanism, which includes a reed valve and a retainer formation plate, is provided for each of a plurality of injection ports, this will increase the number of components and enlarge the motor-driven compressor. In addition, the opening or closing timing of the valve mechanism differs between the injection ports. Thus, the intermediate pressure gas refrigerant is not efficiently delivered to the compression chambers through the injection ports.

It is an object of the present invention to provide a motor-driven compressor that allows for reduction in the number of components, reduction in size, and efficient delivery of refrigerant to a plurality of injection ports.

One aspect of the present invention is a motor-driven compressor including an electric motor and a compression mechanism, which has a compression chamber. The compression mechanism compresses refrigerant drawn into the compression chamber when the electric motor rotates. An accommodation housing accommodates the compression mechanism. A discharge housing including a discharge chamber into which compressed refrigerant is discharged from the compression chamber. A plurality of injection ports are arranged in the accommodation housing. The injection ports deliver intermediate pressure refrigerant, which has an intermediate pressure that is higher than a suction pressure of the refrigerant drawn into the accommodation housing and lower than a discharge pressure of the refrigerant discharged into the discharge chamber, from an external refrigerant circuit to the compression chamber when compression is performed in the compression chamber. An intermediate pressure housing is located between the accommodation housing and the discharge housing. The intermediate pressure housing includes an intake port that draws in the intermediate pressure refrigerant from the external refrigerant circuit, an accommodation recess connected to the intake port, and a plurality of supply passages, each connecting the accommodating recess to one of the injection ports. A valve mechanism is accommodated in the accommodation recess. The valve mechanism is provided with a valve plate including a single valve hole that connects the intake port and the supply passages, and a reed valve formation plate including a reed valve that opens and closes the valve hole. The reed valve is located between the valve plate and the supply passages. The reed valve opens when the intermediate pressure refrigerant is delivered from the external refrigerant circuit and closes to restrict the flow of refrigerant from the supply passages to the intake port.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF THE EMBODIMENTS

One embodiment of a motor-driven compressor will now be described with reference to FIGS. 1 to 6. The motor-driven compressor of the present embodiment is a scroll compressor 10. The scroll compressor 10 is, for example, installed in a vehicle for use with a vehicle air conditioner.

Figure 1:
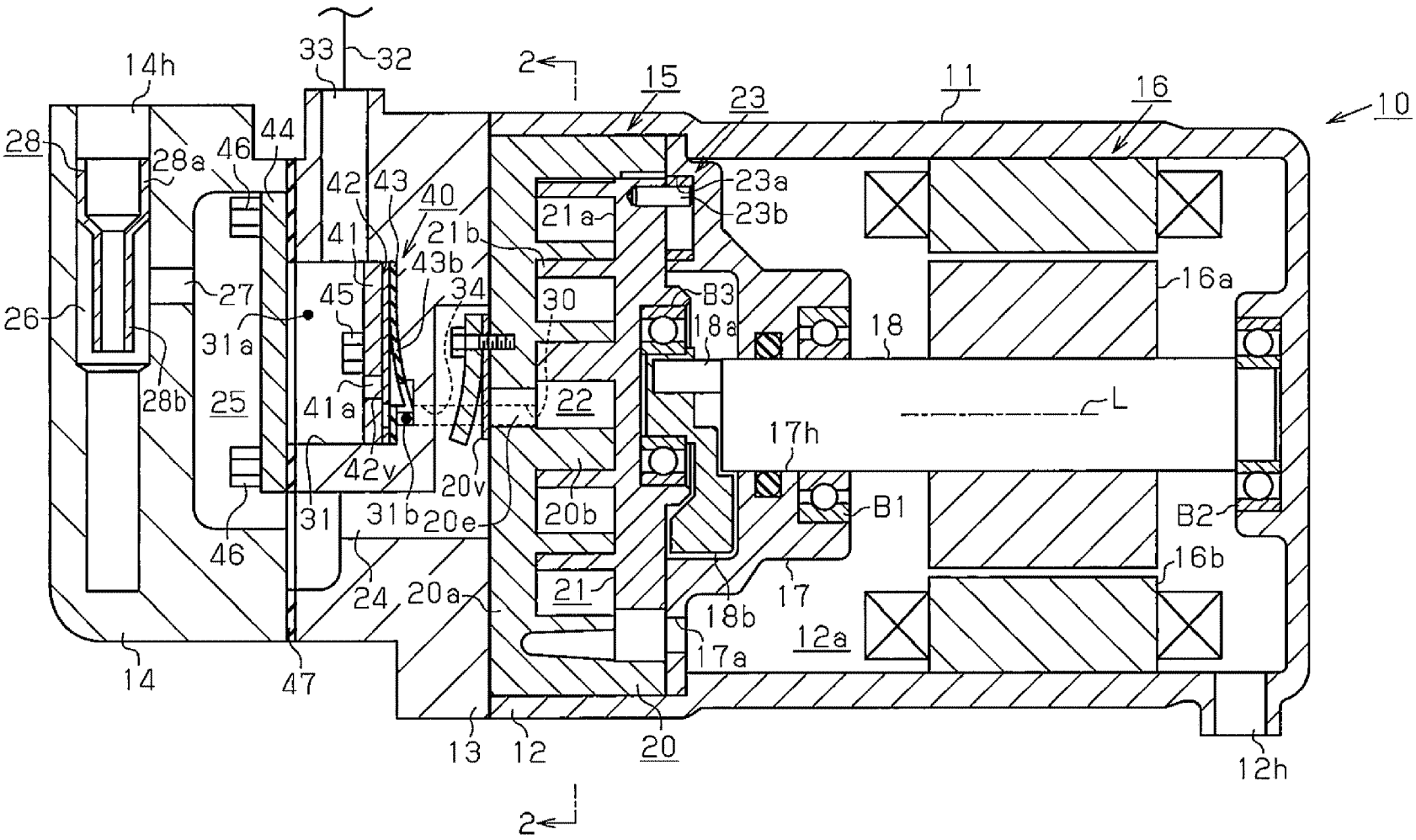
FIG. 1 is a cross-sectional view of a scroll compressor in one embodiment.

As shown in FIG. 1, the scroll compressor 10 includes a housing 11, which is formed from a metal material (aluminum in the present embodiment). The housing includes a suction housing formation body 12, an intermediate pressure housing 13, and a discharge housing 14. The suction housing formation body 12 is tubular and includes an open end (left end as viewed in FIG. 1) and a closed end. The intermediate pressure housing 13 is block-shaped and coupled to the open end of the suction housing formation body 12. The discharge housing 14 is block-shaped and coupled to one end (left end in FIG. 1) of the intermediate pressure housing 13. The intermediate pressure housing 13 is located between the suction housing formation body 12 and the discharge housing 14. The suction housing formation body 12 includes a suction port 12*h*. The discharge housing 14 includes a discharge port 14*h*. The suction housing formation body 12 accommodates a compression mechanism 15, which compresses refrigerant, and an electric motor 16, which is a drive source of the compression mechanism 15.

A shaft support 17 is fixed to the suction housing formation body 12 near the open end. An insertion hole 17*h* extends through a central portion of the shaft support 17. The shaft support 17 and the suction housing formation body 12 define a motor compartment 12*a* that accommodates the electric motor 16. The suction housing formation body 12 accommodates a rotation shaft 18. The rotation shaft 18 includes a first end, located near the open end of the suction housing formation body 12, and a second end, located near the closed end of the suction housing formation body 12. The first end of the rotation shaft 18 is inserted through the insertion hole 17*h* of the shaft support 17 and rotationally supported by a bearing B1 on the shaft support 17. The second end of the rotation shaft 18 is rotationally supported by a bearing B2 on the suction housing formation body 12.

The electric motor 16 includes a rotor 16*a* and a stator 16*b*. The stator 16*b* is fixed to the inner surface of the suction housing formation body 12 surrounding the rotor 16*a*.

The compression mechanism 15 includes a fixed scroll 20 and a movable scroll 21. The fixed scroll 20 includes a fixed base plate 20*a* and a fixed spiral wall 20*b*. The fixed base plate 20*a* is disk-shaped. The fixed spiral wall 20*b* projects from the fixed base plate 20*a*. The movable scroll 21 includes a movable base plate 21*a* and a movable spiral wall 21*b*. The movable base plate 21*a* is disk-shaped. The movable spiral wall 21*b* projects from the movable base plate 21*a* toward the fixed base plate 20*a*. In the present embodiment, the suction housing formation body 12 and the fixed base plate 20*a* form an accommodation housing or suction housing.

The first end of the rotation shaft 18 includes an eccentric rod 18*a*, which projects from a position located away from the rotation axis L of the rotation shaft 18. The eccentric rod 18*a* is fitted to a bushing 18*b*. A bearing B3 rotationally supports the movable base plate 21*a* relative to the bushing 18*b*.

The fixed spiral wall 20*b* and the movable spiral wall 21*b* are engaged with each other. The distal end surface of the fixed spiral wall 20*b* is in contact with the movable base plate 21*a*. The fixed base plate 20*a* and the fixed spiral wall forms compression chambers 22 with the movable base plate 21*a* and the movable spiral wall 21*b*. The shaft support 17 includes a suction passage 17*a*, which connects the motor compartment 12*a* and the compression chambers 22.

A rotation restriction mechanism 23 is arranged between the movable base plate 21*a* and the shaft support 17. The rotation restriction mechanism 23 includes a plurality of (only one shown in FIG. 1) circular recesses 23*a* and a plurality of (only one shown in FIG. 1) pins 23*b*. The circular recesses 23*a* are located in the end surface of the shaft support 17 that opposes the movable base plate 21*a*. The pins 23*b* project from a peripheral portion of the end surface of the movable base plate 21*a* at locations facing the shaft support 17. Further, the pins 23*b* are loosely fitted to the corresponding circular recesses 23*a*.

When the electric motor 16 rotates the rotation shaft 18, the eccentric rod 18*a* causes the movable scroll 21 to orbit around the axis of the fixed scroll 20 (rotation axis L of rotation shaft 18). Here, the rotation restriction mechanism 23 restricts rotation of the movable scroll 21 and permits only the orbiting motion. The orbiting motion of the movable scroll 21 decreases the volume of the compression chambers 22.

An outlet 20*e* is formed in the center of the fixed base plate 20*a*. A discharge valve 20*v*, which is coupled to the fixed base plate 20*a*, covers the outlet 20*e*. The intermediate pressure housing 13 includes a connecting passage 24, which is connected to the outlet 20*e*. The discharge housing 14 includes a discharge chamber 25, which is connected to the connecting passage 24. Further, the discharge housing 14 includes an oil separation chamber 26, which is connected to the discharge port 14*h*, and a passage 27, which connects the discharge chamber 25 and the oil separation chamber 26. The oil separation chamber 26 accommodates an oil separation tube 28 including a large diameter portion 28*a*, which is fitted to the oil separation chamber 26, and a small diameter portion 28*b*, which is located at the lower side of the large diameter portion 28*a* and has a smaller diameter than the small diameter portion 28*b*.

Figure 2:
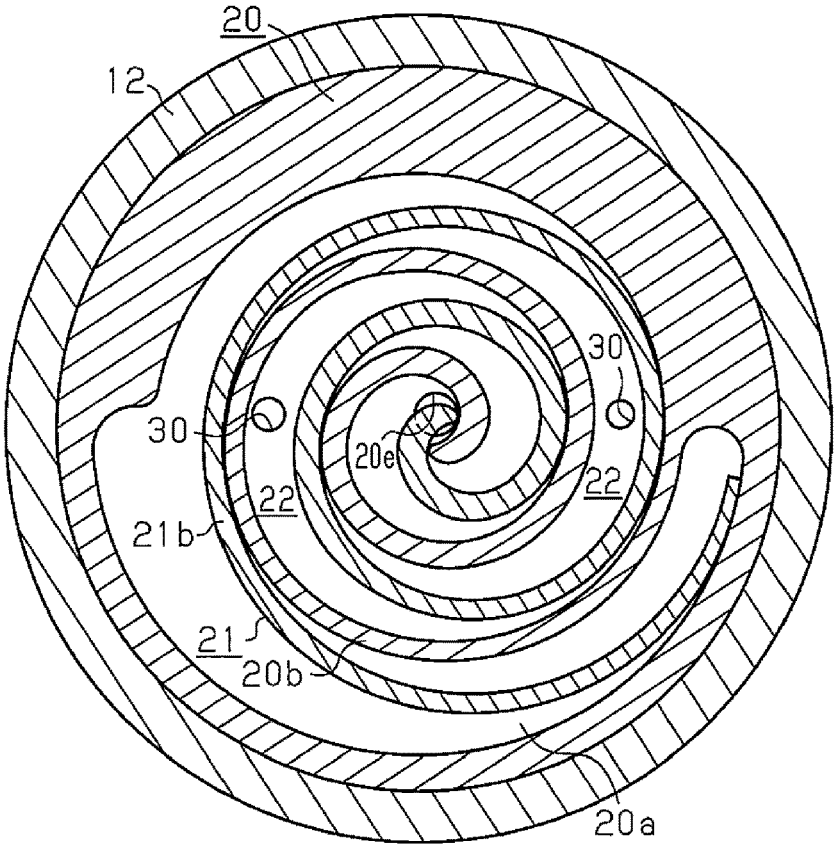
FIG. 2 is a cross-sectional view taken along line 2-2 in FIG. 1.

As shown in FIG. 2, the fixed base plate 20*a* includes two injection ports 30. Each injection port 30 is a through-hole. The size and location of each injection port 30 in the fixed base plate 20*a* are set so that the injection port 30 does not connect adjacent compression chambers 22 when the movable scroll 21 orbits.

Figure 3:
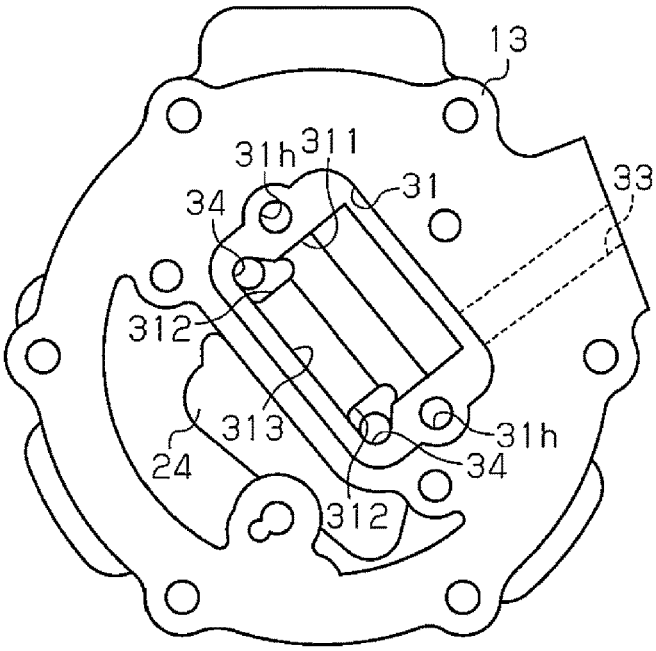
FIG. 3 is a plan view of an intermediate pressure housing.

As shown in FIG. 3, the intermediate pressure housing 13 includes an accommodation recess 31, which is rectangular in a plan view and located in the end surface facing the discharge housing 14. Further, the intermediate pressure housing 13 includes an intake port 33, which is connected to an injection pipe 32 (external refrigerant circuit 50) that delivers intermediate pressure refrigerant to the accommodation recess 31. The bottom wall of the accommodation recess 31 includes a retainer accommodation recess 311. The retainer accommodation recess 311 extends from a central portion of the accommodation recess 31 toward the wall of the accommodation recess 31 located at the opposite side of the intake port 33.

Further, the bottom wall of the accommodation recess 31 is continuous with two corners of the retainer accommodation recess 311 located at the opposite side of the intake port 33 and includes two recesses 312 extending toward the two corners of the retainer accommodation recess 311 located at the opposite side of the intake port 33. Further, the bottom wall of the accommodation recess 31 includes a linking recess 313 that links the two recesses 312. The linking recess 313 is located farther from the intake port 33 than the retainer accommodation recess 311. The bottom wall of each recess 312 includes an opening of a supply passage 34, which is connected to one of the injection ports 30. Thus, the accommodation recess 31 is connected to each supply passage 34. Each supply passage 34 is a through-hole and has the same size as the injection ports 30. Two threaded holes 31*h* are formed in the peripheral portion of the bottom wall of the accommodation recess 31.

As shown in FIG. 1, the accommodation recess 31 includes a valve mechanism 40. The valve mechanism 40 includes a valve plate 41, a reed valve formation plate 42, and a retainer formation plate 43.

Figure 4:
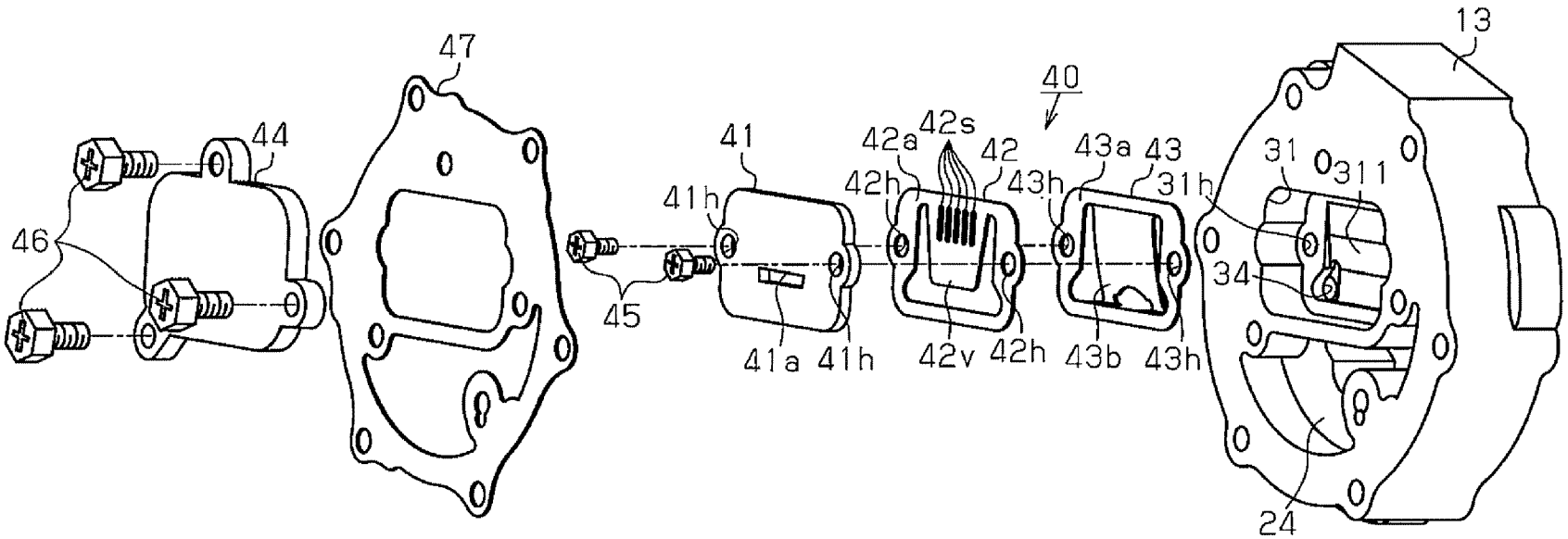
FIG. 4 is an exploded perspective view of the intermediate pressure housing, a valve mechanism, a gasket, and a lid.

As shown in FIG. 4, the valve plate 41 is flat, formed from a metal material (iron in the present embodiment), and has a contour conforming to the wall of the accommodation recess 31. A single valve hole 41*a* is formed in the central portion of the valve plate 41. The valve hole 41*a* is rectangular in a plan view. The peripheral portion of the valve plate 41 includes two bolt insertion holes 41*h*.

The reed valve formation plate 42 is thin, flat, formed from a metal material (iron in the present embodiment), and has a contour conforming to the wall of the accommodation recess 31. The reed valve formation plate 42 includes a frame 42*a* and a reed valve 42*v*, located in a central portion of the reed valve formation plate 42. The reed valve 42*v*, which is trapezoidal in a plan view, extends from the frame 42*a* to the central portion. The reed valve 42*v* is large enough to cover the valve hole 41*a* and includes a distal portion, which opens and closes the valve hole 41*a*, and a basal portion, which includes slits 42*s*. Further, the frame 42*a* includes two bolt insertion holes 42*h*.

The retainer formation plate 43 is thin, flat, formed from a rubber material, and has a contour conforming to the wall of the accommodation recess 31. The retainer formation plate 43 includes a frame 43*a* and a retainer 43*b*, which extends from the frame 43*a* toward the central portion and restricts the open degree of the reed valve 42*v*. The retainer 43*b* is accommodated in the retainer accommodation recess 311. The frame 43*a* includes two bolt insertion holes 43*h*.

The retainer formation plate 43, the reed valve formation plate 42, and the valve plate 41 are arranged in this order on the bottom wall of the accommodation recess 31. When the retainer formation plate 43, the reed valve formation plate 42, and the valve plate 41 are accommodated in the accommodation recess 31, the bolt insertion holes 41*h*, 42*h*, and 43*h* are aligned. Bolts 45 are inserted through the bolt insertion holes 41*h*, 42*h*, and 43*h* and engaged with the threaded holes 31*h* to fasten the retainer formation plate 43, the reed valve formation plate 42, and the valve plate 41 to the bottom wall of the accommodation recess 31.

As shown in FIG. 1, the intake port 33 opens in a wall of the accommodation recess 31 in a direction orthogonal to the rotation axis of the rotation shaft 18 and at a location closer to the discharge housing 14 than the valve plate 41. The reed valve 42*v* is located between the valve plate 41 and the supply passages 34.

A flat lid 44 closes the opening of the accommodation recess 31. The lid 44 is fastened to the intermediate pressure housing 13 by bolts 46 and located in the discharge chamber 25. A portion of a gasket 47 is located between the lid 44 and the intermediate pressure housing 13 to seal the intermediate pressure housing 13 and the discharge housing 14. Thus, the gasket 47 seals off the accommodation recess 31 from the discharge chamber 25.

The valve plate 41 partitions the interior of the accommodation recess 31 into a first chamber 31*a*, which is connected to the intake port 33, and a second chamber 31*b*, which is connected to each supply passage 34. The first chamber 31*a* is defined by the valve plate 41, the walls of the accommodation recess 31, and the lid 44. The second chamber 31*b* is defined by the valve plate 41, the two recesses 312, and the linking recess 313. The frame 43*a* (peripheral portion) of the retainer formation plate 43 seals off the first chamber 31*a* from the second chamber 31*b*. The sealing between the first chamber 31*a* and the second chamber 31*b* provided by the frame 43*a* of the retainer formation plate 43 is ensured by fastening the bolts 45.

Figure 5:
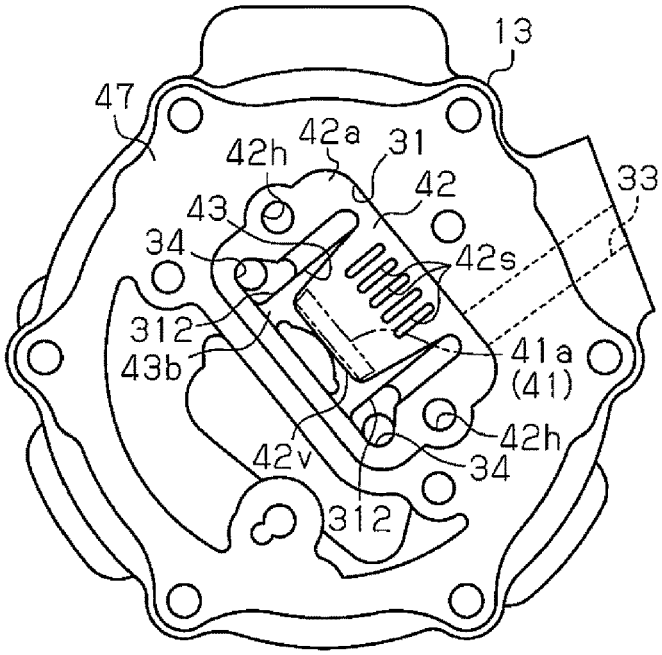
FIG. 5 is a plan view showing a retainer formation plate and a reed valve formation plate coupled to an intermediate pressure housing.

As shown in FIG. 5, the two supply passages 34 are separated by the same distance from the valve hole 41*a*

(shown by double-dashed line in FIG. 5). Thus, the valve hole 41*a* is located between the two supply passages 34.

Figure 6:
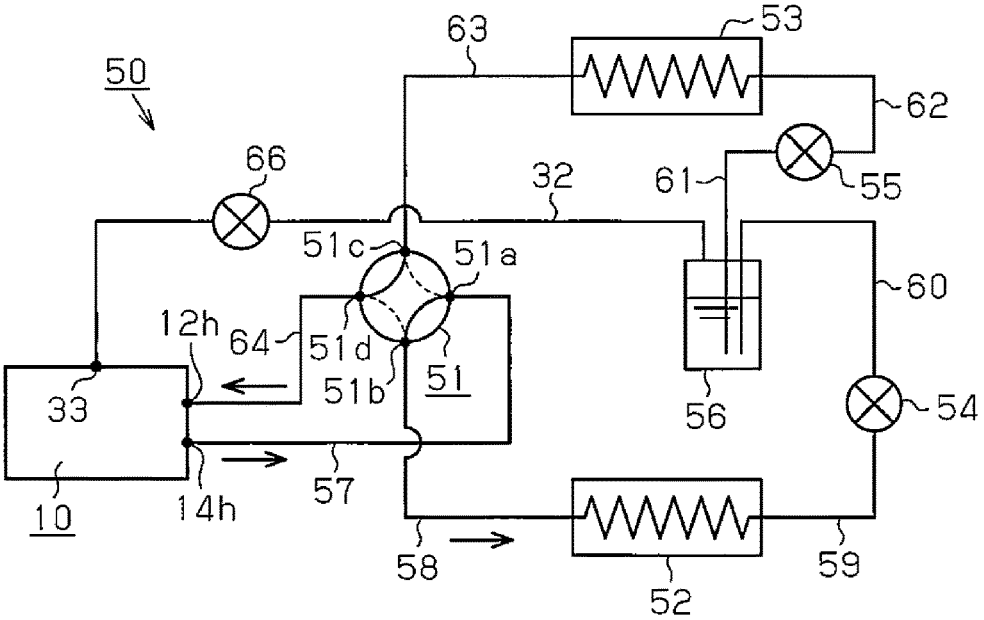
FIG. 6 is a circuit diagram of an external refrigerant circuit.

As shown in FIG. 6, the external refrigerant circuit 50 includes the scroll compressor 10, a pipe switching valve 51, a first heat exchanger 52, a second heat exchanger 53, a first expansion valve 54, a second expansion valve 55, and a gas-liquid separator 56.

The pipe switching valve 51 includes first to fourth ports 51*a*, 51*b*, 51*c*, and 51*d*. The pipe switching valve 51 can be switched between a first condition, in which the first port 51*a* is connected to the second port 51*b* and the third port 51*c* is connected to the fourth port 51*d* as shown by the solid lines in FIG. 3, and a second condition, in which the first port 51*a* is connected to the third port 51*c* and the second port 51*b* is connected to the fourth port 51*d* as shown by the broken lines in FIG. 3.

The discharge port 14*h* is connected to one end of a discharge pipe 57. The other end of the discharge pipe 57 is connected to the first port 51*a* of the pipe switching valve 51. The second port 51*b* of the pipe switching valve 51 is connected to one end of a first pipe 58. The other end of the first pipe 58 is connected to the first heat exchanger 52. The first heat exchanger 52 is connected to one end of a second pipe 59. The other end of the second pipe 59 is connected to the first expansion valve 54.

The first expansion valve 54 is connected to one end of a third pipe 60. The other end of the third pipe 60 is connected to the gas-liquid separator 56. The gas-liquid separator 56 is connected to one end of a fourth pipe 61. The other end of the fourth pipe 61 is connected to the second expansion valve 55. The second expansion valve 55 is connected to one end of a fifth pipe 62. The other end of the fifth pipe 62 is connected to the second heat exchanger 53. The second heat exchanger 53 is connected to one end of a sixth pipe 63. The other end of the sixth pipe 63 is connected to the third port 51*c* of the pipe switching valve 51. The fourth port 51*d* of the pipe switching valve 51 is connected to one end of a suction pipe 64. The other end of the suction pipe 64 is connected to a suction port 12*h*.

The gas-liquid separator 56 is connected to one end of the injection pipe 32. The other end of the injection pipe 32 is connected to the intake port 33. A check valve 66 is arranged in the injection pipe 32.

The operation of the present embodiment will now be described.

When the rotor 16*a* rotates, the rotation shaft 18 causes the movable scroll 21 to produce an orbiting motion. As a result, compression and discharge operations are performed in the compression mechanism 15, and refrigerant circulates through the external refrigerant circuit 50. Refrigerant having a low pressure is drawn through the suction port 12*h* into the motor compartment 12*a*. The orbiting (suction operation) of the movable scroll 21 draws the refrigerant from the motor compartment 12*a* through the suction passage 17*a* into the compression chambers 22. The orbiting (discharge operation) of the movable scroll compresses the refrigerant in the compression chambers 22 and forces the compressed refrigerant out of the discharge valve 20*v* of the outlet 20*e*. Consequently, high pressure refrigerant flows out of the compression chambers 22 through the connecting passage 24 and into the discharge chamber 25.

The refrigerant flows from the discharge chamber 25 through the passage 27 and into the oil separation chamber 26. The refrigerant in the oil separation chamber 26 swirls around the small diameter portion 28*b* and then enters the oil separation tube 28 from the lower opening of the small diameter portion 28*b*.

Lubrication oil is separated from the refrigerant swirled around the small diameter portion 28*b*. The lubrication oil separated from the refrigerant falls to the lower portion of the oil separation chamber 26. Some of the refrigerant in the oil separation chamber 26 and the lubrication oil separated in the oil separation chamber 26 are supplied to the suction housing formation body 12 through a supply passage (not shown) formed in the discharge housing 14 and the intermediate pressure housing 13. This lubricates moving components such as the compression mechanism 15 and the rotation shaft 18.

During a cooling operation, the pipe switching valve 51 is switched to the first condition in which the first port 51*a* is connected to the second port 51*b* and the third port 51*c* is connected to the fourth port 51*d*. Thus, the refrigerant discharged into the discharge pipe 57 flows to the first heat exchanger 52 via the first port 51*a*, the second port 51*b*, and the first pipe 58. The refrigerant in the first heat exchanger 52 exchanges heat with the ambient air and condenses. The refrigerant condensed by the first heat exchanger 52 flows to the first expansion valve 54 via the second pipe 59. The first expansion valve 54 depressurizes and adjusts the refrigerant to an intermediate pressure between the discharge pressure (high pressure) and the suction pressure (low pressure). The intermediate pressure refrigerant flows into the gas-liquid separator 56 via the third pipe 60. The gas-liquid separator 56 separates the refrigerant into a gas refrigerant and a liquid refrigerant.

The liquid refrigerant obtained by the gas-liquid separator 56 flows to the second expansion valve 55 via the fourth pipe 61. The second expansion valve 55 depressurizes the liquid refrigerant. The depressurized liquid refrigerant flows to the second heat exchanger 53 via the fifth pipe 62.

The liquid refrigerant in the second heat exchanger 53 exchanges heat with the air in the passenger compartment and evaporates. This cools the air in the passenger compartment. The refrigerant evaporated by the second heat exchanger 53 is returned to the motor compartment 12*a* via the sixth pipe 63, the third port 51*c*, the fourth port 51*d*, the suction pipe 64, and the suction port 12*h*.

The gas refrigerant separated from the liquid refrigerant by the gas-liquid separator 56 flows to the injection pipe 32. When cooling the air in the passenger compartment (cooling operation), the temperature and pressure of the refrigerant drawn into the motor compartment 12*a* are both high. Thus, the difference between the pressure of the scroll compressor 10 and the pressure of the gas-liquid separator 56 causes the check valve 66 to close the injection pipe 32. This restricts the flow of gas refrigerant from the injection pipe 32 to the intake port 33.

During a warming operation, the pipe switching valve 51 is switched to the second condition in which the first port 51*a* is connected to the third port 51*c* and the second port 51*b* is connected to the fourth port 51*d*. Thus, the refrigerant discharged into the discharge pipe 57 flows to the second heat exchanger 53 via the first port 51*a*, the third port 51*c*, and the sixth pipe 63. The refrigerant in the second heat exchanger 53 exchanges heat with the air in the passenger compartment and condenses. This warms the air in the passenger compartment. The refrigerant condensed by the second heat exchanger 53 flows to the second expansion valve 55 via the fifth pipe 62. The second expansion valve 55 depressurizes and adjusts the refrigerant to an intermediate pressure, which is higher than the suction pressure and lower than the discharge pressure. The intermediate pressure refrigerant flows into the gas-liquid separator 56 via the fourth pipe 61. The gas-liquid separator 56 separates the refrigerant into a gas refrigerant and a liquid refrigerant.

The liquid refrigerant separated from the liquid refrigerant by the gas-liquid separator 56 flows to the first expansion valve 54 via the third pipe 60. The first expansion valve 54 depressurizes the liquid refrigerant. The depressurized liquid refrigerant flows to the first heat exchanger 52 via the second pipe 59. The liquid refrigerant in the first heat exchanger 52 exchanges heat with the ambient air and evaporates. The refrigerant evaporated by the first heat exchanger 52 is returned to the motor compartment 12*a* via the first pipe 58, the second port 51*b*, the fourth port 51*d*, the suction pipe 64, and the suction port 12*h*.

The gas refrigerant separated from the liquid refrigerant by the gas-liquid separator 56 flows to the injection pipe 32. When warming the air in the passenger compartment (warming operation), the temperature and pressure of the refrigerant drawn into the motor compartment 12*a* are both low. Thus, the difference between the pressure of the scroll compressor 10 and the pressure of the gas-liquid separator 56 causes the injection pipe 32 to open the check valve 66. This permits the flow of gas refrigerant from the injection pipe 32 to the intake port 33.

When the gas refrigerant (intermediate pressure refrigerant) is delivered from the injection pipe 32 to the intake port 33, the intermediate pressure refrigerant flows into the first chamber 31*a* and the valve hole 41*a*. The pressure of the intermediate pressure refrigerant acts on the reed valve 42*v* and opens the reed valve 42*v*. Here, the reed valve 42*v* contacts the retainer 43*b* and restricts the open degree of the retainer 43*b*. Thus, the intermediate pressure refrigerant is delivered from the injection pipe 32 to the compression chambers 22 undergoing compression via the intake port 33, the first chamber 31*a*, the valve hole 41*a*, the second chamber 31*b*, the supply passages 34, and the injection ports 30. When a valve mechanism 40 is arranged in each injection port 30, the valve mechanism 40 of one injection port 30 would open or close at a timing that differs from that of another injection port 30. Such a situation does not occur in this embodiment, and the gas refrigerant is efficiently delivered to each injection port 30.

As shown in FIG. 5, the two supply passages 34 are separated by the same distance from the valve hole 41*a*. Thus, in contrast with when, for example, the two supply passages 34 are separated by different distances from the valve hole 41*a*, the intermediate pressure refrigerant that has passed through the valve hole 41*a* uniformly flows to each supply passage 34. Further, the valve hole 41*a* is located at a central position between the two supply passages 34. Thus, compared to when, for example, the valve hole 41*a* is located closer to one of the supply passages 34, the intermediate pressure refrigerant that has passed through the valve hole 41*a* easily flows in a uniform manner to the supply passages 34.

The intermediate pressure refrigerant sent to the compression chambers 22, which are undergoing compression, through the injection ports 30 increases the amount of gas refrigerant that flows into the compression chambers 22. This improves the performance of the scroll compressor 10 during a high-load operation such as during a warming operation.

The reed valve 42*v* closes when the pressure of the intermediate pressure refrigerant from the injection pipe 32 no longer acts on the reed valve 42*v*. Thus, the gas refrigerant that flows from the compression chambers 22 to the second chamber 31*b* via the injection ports 30 and the supply passages 34 does not further flow to the first chamber 31*a* through the valve hole 41*a*. This restricts a reversed flow of the gas refrigerant to the injection pipe 32.

The above embodiment has the advantages described below.

(1) The valve mechanism 40 is accommodated in the accommodation recess 31. The valve mechanism 40 includes the valve plate 41 and the reed valve formation plate 42. The valve plate 41 includes the single valve hole 41*a*, which connects the intake port 33 and the supply passages 34. The reed valve formation plate 42, which is located between the valve plate 41 and the supply passages 34, includes the reed valve 42*v*, which opens and closes the valve hole 41*a*. When the reed valve 42*v* opens, intermediate pressure refrigerant from the injection pipe 32 is delivered to the compression chambers 22 via the intake port 33, the first chamber 31*a*, the valve hole 41*a*, the second chamber 31*b*, the supply passages 34, and the injection ports 30. When the reed valve 42*v* closes, the refrigerant from the compression chambers 22 flowing to the injection ports 30, the supply passages 34, and the second chamber 31*b* does not flow to the first chamber 31*a* through the valve hole 41*a*. In other words, the reversed flow of refrigerant to the injection pipe 32 is prevented. Accordingly, the reversed flow of refrigerant from the compression chambers 22 to the external refrigerant circuit 50 via the injection port can be restricted just by accommodating the valve mechanism 40 in the accommodation recess 31. Thus, in comparison with when a valve mechanism 40 is arranged in each injection port 30, the number of components can be reduced and the scroll compressor 10 can be reduced in size. Further, when the reed valve 42*v* opens, the intermediate pressure temperature from the external refrigerant circuit 50 is delivered to each supply passage 34 and each injection port through the single valve hole 41*a* of the valve plate 41. If a valve mechanism 40 were to be arranged in each injection port 30, the valve mechanism 40 of one injection port 30 would open or close at a timing that differs from that of another injection port 30. Such a situation does not occur in this embodiment. Thus, the gas refrigerant is efficiently delivered to each injection port 30.

(2) The two supply passages 34 are separated by the same distance from the valve hole 41*a*. Thus, in contrast with when, for example, the two supply passages 34 are separated by different distances from the valve hole 41*a*, the intermediate pressure refrigerant that has passed through the valve hole 41*a* uniformly flows to each supply passage 34.

(3) The valve hole 41*a* is located at a central position between the two supply passages 34. Thus, compared to when, for example, the valve hole 41*a* is located closer to one of the supply passages 34, the intermediate pressure refrigerant that has passed through the valve hole 41*a* easily flows in a uniform manner to the supply passages 34.

(4) The distal portion of the reed valve 42*v* opens and closes the valve hole 41*a*, and the basal portion of the reed valve 42*v* includes the slits 42*s*. This allows the reed valve 42*v* to smoothly open as compared to a structure in which that basal portion of the reed valve 42*v* does not include the slits 42*s* and the entire surface of the reed valve 42*v* contacts the valve plate 41.

(5) The reed valve 42*v* has a quicker response than, for example, a spool valve that reciprocates between an open valve position and a close valve position in accordance with the relationship between the urging force of a coil spring and the pressure of intermediate pressure refrigerant from an injection pipe. Thus, the scroll compressor 10 has satisfactory performance during a high load operation such as during a warming operation.

It should be apparent to those skilled in the art that the present invention may be embodied in many other specific forms without departing from the spirit or scope of the invention. Particularly, it should be understood that the present invention may be embodied in the following forms.

In the above embodiment, the valve hole 41*a* may be located near one of the supply passages 34.

In the above embodiment, the two supply passages 34 may be separated by different distances from the valve hole 41*a*.

In the above embodiment, the slits 42*s* do not have to be formed in the basal portion of the reed valve 42*v*.

In the above embodiment, the shape of the reed valve 42*v* is not particularly limited. The distal portion of the reed valve 42*v* only needs to be shaped to allow for opening and closing of the valve hole 41*a*.

In the above embodiment, the shape of the valve hole 41*a* is not particularly limited. In this case, the distal portion of the reed valve 42*v* is changed to a shape that allows for opening and closing of the valve hole 41*a*.

In the above embodiment, the fixed base plate 20*a* may include three or more injection ports 30. In this case, the three or more supply passages 34 are formed in the bottom wall of the accommodation recess 31.

In the above embodiment, each injection port 30 and each supply passage 34 may have, for example, an elliptical shape conforming to the spiral shape of the fixed spiral wall 20*b*. That is, the shape of each injection port 30 and each supply passage 34 is not particularly limited.

In the above embodiment, the reed valve formation plate 42 and the retainer formation plate 43 do not have to be fastened to the bottom wall of the accommodation recess 31 by the bolts 45. For example, the reed valve formation plate 42 and the retainer formation plate 43 may be fastened to the valve plate 41 by fasteners (e.g., bolts). In this case, a gasket used for sealing is additionally arranged between the first chamber 31*a* and the second chamber 31*b*.

In the above embodiment, the scroll compressor 10 does not have to be used in a vehicle air conditioner and may be used for another type of air conditioner.

In the above embodiment, the motor-driven compressor is not limited to a scroll type and may be, for example, of a vane type or a roots type.

The above description is intended to be illustrative, and not restrictive. For example, the above-described examples (or one or more aspects thereof) may be used in combination with each other. Other embodiments can be used, such as by one of ordinary skill in the art upon reviewing the above description. Also, in the above Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Description, with each claim standing on its own as a separate embodiment. The scope of the invention should be determined with reference to the appended claims, along with the full scope of equivalents to which such claims are entitled.

The invention claimed is:

1. A motor-driven compressor comprising:

an electric motor;

a compression mechanism including a compression chamber and configured to compress refrigerant drawn into the compression chamber when the electric motor rotates;

an accommodation housing configured to accommodate the compression mechanism;

a discharge housing including a discharge chamber into which compressed refrigerant is discharged from the compression chamber;

a plurality of injection ports arranged in the accommodation housing and configured to deliver intermediate pressure refrigerant, which has an intermediate pressure that is higher than a suction pressure of the refrigerant drawn into the accommodation housing and lower than a discharge pressure of the refrigerant discharged into the discharge chamber, from an external refrigerant circuit to the compression chamber when compression is performed in the compression chamber;

an intermediate pressure housing located between the accommodation housing and the discharge housing, wherein the intermediate pressure housing includes an intake port configured to draw in the intermediate pressure refrigerant from the external refrigerant circuit, an accommodation recess connected to the intake port, and a plurality of supply passages, each connecting the accommodating recess to one of the injection ports; and a valve mechanism accommodated in the accommodation recess;

wherein the valve mechanism includes a valve plate including a single valve hole, the valve hole being configured to connect the intake port and the plurality of supply passages, and a reed valve formation plate including a reed valve, the reed valve being located between the valve plate and the plurality of supply passages and configured to open and close the valve hole, the reed valve is configured to open when the intermediate pressure refrigerant is delivered from the external refrigerant circuit and close to restrict the flow of refrigerant from the plurality of supply passages to the intake port, the motor-driven compressor further comprises a lid, and the accommodation recess comprises an opening and an accommodation chamber that accommodates the valve mechanism, wherein the accommodation chamber is formed by the opening of the accommodation recess being closed by the lid, the accommodation chamber further includes a first inner wall including openings of the plurality of supply passages, and a second inner wall serving as the valve plate and having the single valve hole, and the reed valve is located in the accommodation chamber to open and close the single valve hole.

2. The motor-driven compressor according to claim 1, wherein the accommodation housing further accommodates the electric motor.

3. The motor-driven compressor according to claim 1, wherein the plurality of supply passages are separated by the same distance from the valve hole.

4. The motor-driven compressor according to claim 3, wherein the injection ports include two injection ports formed in the accommodation housing, the plurality of supply passages include two supply passages respectively connected to the two injection ports and formed in the intermediate pressure housing, and the valve hole is located between the two supply passages.

5. The motor-driven compressor according to claim 1, wherein the reed valve includes one end, which is configured to open and close the valve hole, and the other end, which includes a plurality of slits.

6. The motor-driven compressor according to claim 1, wherein the valve mechanism further includes a retainer formation plate having a retainer, the retainer being configured to restrict an open degree of the reed valve.

* * * * *